US010559404B2

(12) United States Patent
Neumann et al.

(10) Patent No.: US 10,559,404 B2
(45) Date of Patent: Feb. 11, 2020

(54) TRACEABLE POWER CABLE AND METHOD

(71) Applicant: Prysmian S.p.A., Milan (IT)

(72) Inventors: Andreas Neumann, Milan (IT); Frank Lübbe, Milan (IT)

(73) Assignee: PRYSMIAN S.p.A., Milan (IT)

( * ) Notice: Subject to any disclaimer, the term of this patent is extended or adjusted under 35 U.S.C. 154(b) by 0 days.

(21) Appl. No.: 16/307,234

(22) PCT Filed: Jun. 8, 2017

(86) PCT No.: PCT/EP2017/063914
§ 371 (c)(1),
(2) Date: Dec. 5, 2018

(87) PCT Pub. No.: WO2017/211926
PCT Pub. Date: Dec. 14, 2017

(65) Prior Publication Data

US 2019/0304628 A1 Oct. 3, 2019

(30) Foreign Application Priority Data

Jun. 8, 2016 (WO) ..... PCT/EP2016/062959

(51) Int. Cl.
*H01B 7/36* (2006.01)
*H01B 13/34* (2006.01)

(52) U.S. Cl.
CPC ..... *H01B 7/366* (2013.01); *H01B 13/345* (2013.01)

(58) Field of Classification Search
CPC combination set(s) only.
See application file for complete search history.

(56) References Cited

U.S. PATENT DOCUMENTS 5,069,769 A * 12/1991 Fujimiya ..... G01N 27/44704 204/461
2018/0259676 A1* 9/2018 Dunn ..... G01V 15/00

FOREIGN PATENT DOCUMENTS

DE 102011080298 A1 2/2013
GB 2489800 A 10/2012
GB 2501938 A 11/2012

OTHER PUBLICATIONS

International Search Report and Written Opinion of corresponding International Application No. PCT/EP2017/063914; dated Jul. 5, 2017; 8 pages.
"Conductors of Insulated Cables": Norme Internatiional Standard; CEI IEC 60228; Third Edition; dated Nov. 2004; International Electrotechnical Commission; 46 pages.

* cited by examiner

*Primary Examiner* — William H. Mayo, III
*Assistant Examiner* — Krystal Robinson
(74) *Attorney, Agent, or Firm* — Shumaker, Loop & Kendrick, LLP

(57) ABSTRACT

It is disclosed a power cable comprising at least one conductor and a hollow tube at least partially filled with a traceable material. The traceable material comprises a tracer associated with a uniquely identifiable code and is in a liquid or gel form. The tracer may comprise one or more of: coded synthetic DNA particles, a fingerprint of one or more trace materials, microdots containing a code written thereon. The tracer may also comprise radio-frequency identification, RFID, tags.

17 Claims, 6 Drawing Sheets

TRACEABLE POWER CABLE AND METHOD

CROSS REFERENCE TO RELATED PATENT APPLICATIONS

This application claims the benefit of and priority to International Application No. PCT/EP2017/063914 filed on Jun. 8, 2017, which claims the priority to International Application No. PCT/EP2016/062959 filed on Jun. 8, 2016. The entire contents of each are hereby incorporated by reference in the entirety.

TECHNICAL FIELD AND BACKGROUND OF THE INVENTION

The present invention relates to the field of cables. In particular, the present invention relates to a traceable power cable and a method for providing a traceable power cable.

As known, electrical cables used for the energy transmission (also referred to as "power cables") comprise a number of conductors, which are made of a metal material such as copper, aluminum or a copper alloy. The conductors of power cables, and in particular the conductors made of copper, are often the target of thefts. As power cables may be extensively used to supply energy in transport networks (such as rail networks) and in telecommunication networks, the theft of cable conductors entails a huge economic loss for the cable owner and may also cause heavy inconveniences for the users of the transport or telecommunication networks. When the conductors are offered to a metal scrap dealer, it is almost impossible to prove that such conductors were stolen.

There is therefore the need to face the problem outlined above by providing the power cables with an identification of ownership. If the owner may be identified, it is possible to prove that the conductor has been stolen and take adequate countermeasures to prevent thefts.

BACKGROUND OF THE PRIOR ART

GB 2489800 A discloses a method comprising the steps of providing one or more wires to be included in a cable; applying a marker system, preferably SmartWater® but many others are considered, to the one or more wires; and coating the one or more wires having the marker thereon with an insulating layer to form the cable. A device capable of executing the method and a uniquely identifiable cable comprising a marker system formed by the method are disclosed.

GB 2501938 A discloses a cable comprising internal conductors and an exterior sheath. Identifiers are present along the length of the internal conductors and a warning notice is present on the exterior sheath. The identifiers may also be present on any screening layer. A method of manufacturing a cable is also disclosed. In the described embodiments the identifiers make use of the DataDot® systems.

DE 10 2011 080298 A1 discloses a method for labeling surrounding sheath and/or insulation of object such as electrical conductor used in wire or cable. The method involves injecting a marker dye comprised of several DNA molecules, into object through the sheath and/or insulation.

SUMMARY OF THE INVENTION

The Applicant noticed that according to GB 2489800 A and GB 2501938 A, identifiers are applied on the conductors and/or on other elements of the cable for making it traceable. In the present description, the expression "traceable power cable" will indicate a power cable that may be uniquely identified.

The Applicant has noticed that the method of DE 10 2011 080298 A1 has several disadvantages. First, the marker dye is injected in a volume between conductors. This volume is rather large and therefore, a high amount of marker dye is required. In addition, a perfect sealing should be provided between the conductors in order to keep the marker dye confined between the conductors. Finally, the method should be carried out after manufacturing the cable and not during manufacturing.

The Applicant noticed that, according to the cited prior art, the conductors are marked during manufacturing of the power cable. This brings about the risk of contaminating the cable production site or the risk of cross-contamination of the cables from consecutive production runs on the same manufacturing machine.

Furthermore, in case the cable is stolen and found later on, the identifiers that are applied on the conductors and/or other elements of the cable allow identifying it but they do not provide any help in finding the offenders.

In view of the above, the Applicant has tackled the problem of providing a traceable power cable which allows overcoming at least one of the drawbacks set forth above. In particular, the Applicant has tackled the problem of providing a traceable power cable which allows avoiding the risk of contamination of the cable production site and/or the risk of cross-contamination of the cables from consecutive productions runs, and which, at the same time, may provide a stronger deterrent for cable thieves.

The Applicant found that the technical problem above may be solved by a power cable that comprises a hollow element (such as, for instance, a hollow tube) filled with a traceable material comprising a tracer with a uniquely identifiable code. The uniquely identifiable code may contain information regarding one or more of: a cable owner, a cable location or installation site, a cable type, a year of construction, a manufacturer identifier. Other information may be comprised in the uniquely identifiable code providing an identification of the cable. According to a preferred embodiment of the present invention, the traceable material is a liquid or gel that contains coded synthetic DNA particles providing the uniquely identifiable code cited above. According to alternative embodiments of the present invention, the tracer may be a fingerprint of one or more trace materials or microdots containing a code written thereon. According to even alternative embodiments, the tracer may be a combination of synthetic DNA particles, a fingerprint of one or more trace materials and/or microdots containing a code written thereon.

According to embodiments of the present invention, the hollow element can be provided in the cable either as an independent element in between the conductors of the cable or as part of a single multiwire conductor.

Advantageously, according to the present invention, the traceable material can be filled in the hollow element of the cable after the cable leaves the cable manufacturing site, at the installation site (either before or during laying down the cable).

This avoids the risk of contaminating the cable manufacturing site or the risk of cross-contamination of the cables from consecutive production runs on the same manufacturing machine.

Moreover, according to the present invention, when the cable is cut by a thief, the hollow element containing the liquid composition with the tracer is also cut so that the liquid composition leaks from the hollow element. In this case, the liquid composition flows on the conductors and the other elements of the cable and sticks on them. Therefore, as a result, the liquid composition with the tracer is applied on the cable elements and provides each of them with the uniquely identifiable code. The liquid composition with the tracer also sticks on the tools used to cut the cable as well as on the objects that are come into contact with it, such as, for instance, the clothes or the skin of the thieves. The presence of the uniquely identifiable code on the cable elements makes them immediately identifiable in case of theft. Moreover, the presence of the liquid composition with the tracer also in the objects used for the theft and on the individuals who came into contact with the liquid composition may significantly enhance the overall detection rate as it permits to connect those individuals and objects with the theft. Finally, the fact that the liquid composition may stick on individuals and objects involved in the theft, is a strong deterrence measure for preventing cable thefts.

In one aspect, the present invention relates to power cable comprising at least one conductor and a hollow tube at least partially filled with a traceable material, wherein the traceable material comprises a tracer associated with a uniquely identifiable code and wherein the traceable material is in a liquid or gel form.

Preferably, the tracer comprises one or more of: coded synthetic DNA particles, a fingerprint of one or more trace materials, microdots containing a code written thereon.

According to embodiments, the tracer comprises radio-frequency identification, RFID, tags.

Preferably, the hollow tube has an inner diameter comprised between about 1 mm and about 10 mm.

Preferably, the hollow tube has an outer diameter substantially corresponding to a dimension of an element of the power cable.

According to embodiments of the present invention, the total conductor cross section of the power cable is equal to or greater than 120 $mm^2$.

According to an embodiment of the present invention, the hollow tube is an independent element. More in particular, the hollow tube may be an independent element in between the at least one conductor of the cable. In the present description and claims, an independent element is intended to be a hollow tube solely delimited by an outer surface thereof. For the present description and claims, an independent element does not include an element delimited, partially or completely, by a further element of the cable.

Preferably, the outer diameter of the hollow tube substantially corresponds to a diameter of a cross section of said at least one conductor. The language "substantially corresponds" in the present description and claims means that the hollow tube has a dimension in cross-section such that it can take the place of a conductor without affecting the dimension of the cable. Therefore, the above expression both includes the case in which the diameter of the hollow tube is slightly smaller than the diameter of a conductor and the case in which the diameter of the hollow tube is slightly larger than the diameter of the conductor.

According to another embodiment of the present invention, the at least one conductor is a multiwire conductor and the hollow tube is part of the multiwire conductor. Preferably, the cross section of said at least one conductor is equal to or greater than 120 $mm^2$. Moreover, preferably, the outer diameter substantially corresponds to a diameter of a wire or a bunch of wires of the multiwire conductor.

Preferably, the hollow tube is obtained by extrusion.

Preferably, the hollow tube is made of PVC.

In another aspect, the present invention relates to a method for providing a traceable power cable comprising providing at least one conductor and a hollow tube within the cable, and filling the hollow tube with a traceable material, wherein the traceable material comprises a tracer associated with a uniquely identifiable code and wherein the traceable material is in a liquid or gel form.

Preferably, filling is performed at an installation site.

Filling the hollow tube with a traceable material having a tracer may comprise filling the hollow tube with a traceable material comprising one or more of: coded synthetic DNA particles, a fingerprint of one or more trace materials, microdots containing a code written thereon.

Alternatively, filling the hollow tube with a traceable material having a tracer may comprise filling the hollow tube with a traceable material comprising radio-frequency identification, RFID, tags.

According to embodiments, filling the hollow tube with a traceable material having a tracer may comprise filling an independent element of the power cable.

BRIEF DESCRIPTION OF THE DRAWINGS

The present invention will become fully clear by reading the following detailed description, to be read by referring to the accompanying drawings, wherein.

DETAILED DESCRIPTION OF PREFERRED EMBODIMENTS

Figure 1:
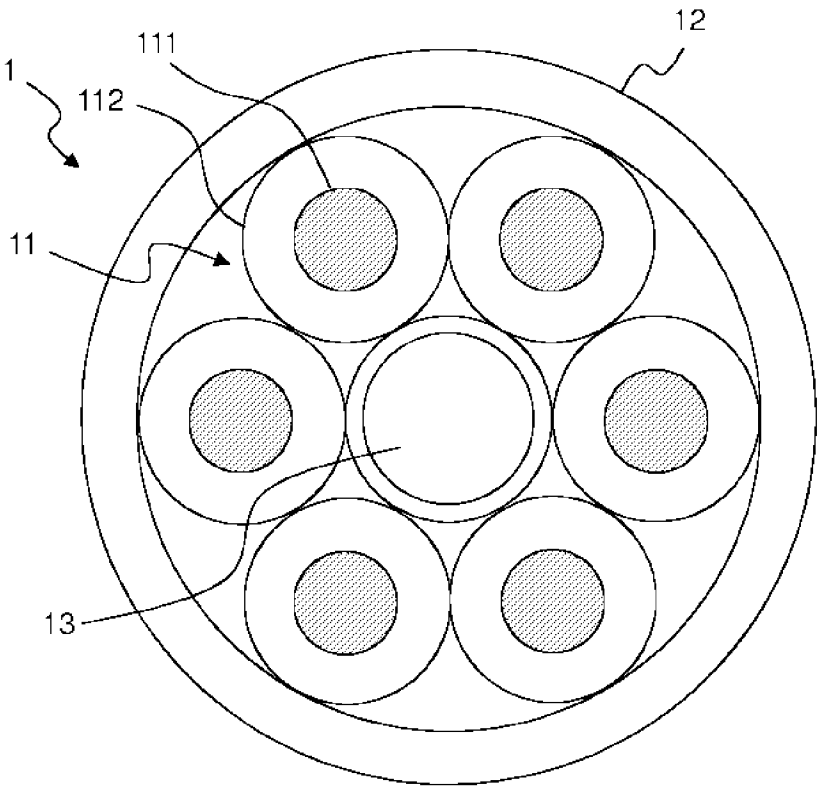
FIG. 1 is a cross section view of a cable according to a first embodiment of the present invention.

In the present description and claims, unless otherwise specified, all the numbers and values should be intended as preceded by the term "about".

The present invention provides a power cable comprising a hollow tube adapted to be filled at least partially with a material comprising a tracer with a uniquely identifiable code. This material will be referred to in the present description and in the claims as "traceable material". The hollow tube, according to the present invention, may be positioned within the power cable as replacing a core element (namely, a power or control conductor) or another element in any position within the cable, either in the center of the cable or in each layer of core elements within the cable. In this case, the hollow tube is preferably integrated with the core elements during stranding of the core elements. Alternatively or in addition, the hollow tube may replace a single wire or a bunch of wires of a power or control conductor. Moreover, alternatively or in addition, the hollow tube may be positioned in an interstice between any two or more cable elements, for instance between two or more power and/or control conductors in the cable, and/or between the power and/or control conductors and a sheath of the cable, and/or between the power and/or control conductors and a central element of the cable.

The traceable material is preferably in the form of a liquid or a gel and it may be water-based.

The tracer preferably comprises coded synthetic DNA particles.

Alternatively, the tracer preferably comprises a radio-frequency identification (RFID) tag or the like. As it is known, RFID uses electromagnetic fields to automatically identify and track tags attached to objects and containing electronically stored information. More preferably, the tracer comprises a plurality of RFID tags.

Alternatively, the tracer preferably comprises a fingerprint of one or more trace materials, or microdots containing a code written thereon.

According to even alternative embodiments of the present invention the tracer comprises a combination of two or more of the coded synthetic DNA particles, the RFID tag(s), the fingerprint of one or more trace materials and the microdots containing a code written thereon.

Moreover, optionally, the traceable material may contain also fluorescent components adapted to be identifiable under a source of light, e.g. a source of ultraviolet light.

The uniquely identifiable code associated with the tracer may contain information regarding one or more of: an owner of the cable, a location or installation site, a cable type, a year of construction, a manufacturer identifier. Other information may be coded in the uniquely identifiable code which provides identification data of the cable.

The dimensions of the hollow tube are selected on the basis of the cable construction. According to the present invention, the hollow tube has an inner diameter whose value is selected preferably within a range of 1 mm to 10 mm. Preferably, the inner diameter is selected such that the traceable material may be easily filled throughout the entire length of the tube and that the traceable material is enough to allow identification of the cable. On the other side, the inner diameter is preferably selected such that the amount of traceable material is not too high, since in this case it would determine excessive expenses.

According to the present invention, the outer diameter of the hollow tube may vary on the basis of the cable construction. Preferably, the outer diameter of the hollow tube substantially correspond to a dimension of a cable element, which the hollow tube may replace. This element may be either the dimension of a conductive power or control core, or the dimension of a single wire or bunch of wires in a conductive core. Alternatively, the hollow tube may have the dimension of another element of the cable, such as a central element. According to the cable construction, the hollow tube may, for instance, replace a conductor or a single wire and hence the outer diameter may substantially correspond to, respectively, the diameter of the cross section of the conductor or the diameter of the single wire. On the contrary, the inner diameter of the hollow tube may have a predetermined value, irrespective of the cable construction. This advantageously implies that connectivity of the hollow tubes may be easily achieved by using the same connectivity technology for different cables. Moreover, the same amount of traceable material is advantageously used irrespective of the cable construction.

The hollow rube is preferably obtained by extrusion. The material of the hollow tube may be PVC (polyvinylchloride).

In the following description, a number of different embodiments of the present invention will be described.

FIG. 1 schematically shows a cross section of a power cable 1 according to a first embodiment of the present invention. Cable 1 is preferably a multicore power cable. Preferably, the cable 1 comprises a number of core elements 11, comprising:

a power or earth conductor 111 coated by a respective insulating sleeve 112, wherein the conductor 111 may comprise a number of stranded conductive wires; or a control or signaling element (e.g. one or more twisted pairs or quads with screen and insulation), or an optical element comprising one or more optical fibers and mechanical protection; or a suspension element (e.g. Kevlar thread), or any combination thereof.

Preferably, the cable 1 also comprises a sheath 12. The cable 1 may comprise other layers above the sheath 12 (e.g. a metallic screen and/or an external sheath), which are not shown in FIG. 1 as they are not relevant to the present description.

The material of each conductor 111 is preferably one of: copper, aluminum, copper alloy. Each insulating sleeve 112 and the sheath 12 may be made of any insulating material such as one of the following materials: PVC (polyvinylchloride), rubber, XLPE (cross-linked polyethylene), PUR (polyurethane), PTFE (polytetrafluoroethylene), ETFE (ethylene tetrafluoroethylene).

The cable 1 further preferably comprises a hollow element 13 in the form of a hollow tube adapted to be filled at least partially with the traceable material described above. The material of the hollow tube 13 is preferably chosen so that it is heat resistant and the material of the hollow tube 13 may be PVC (polyvinylchloride). The hollow tube 13 has preferably an inner diameter comprised between about 1 mm and 10 mm. According to this first embodiment of the invention, the outer diameter of the hollow tube 13 is substantially equal to the diameter of a core element 21.

In the exemplary cable of FIG. 1, the hollow tube 13 is positioned substantially at the center of the cable 1.

Figure 2:
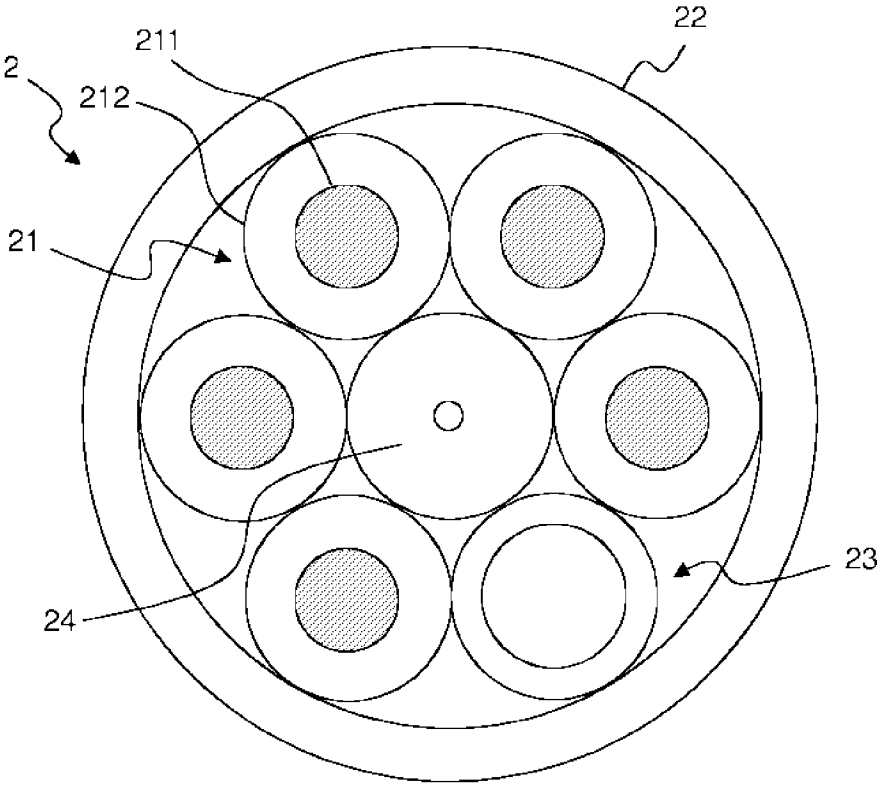
FIG. 2 is a cross section view of a cable according to a second embodiment depicted in FIG. 1.

FIG. 2 schematically shows the cross section of a power cable 2 according to a second embodiment of the present invention. Similarly to the cable 1 of FIG. 1, the cable 2 according to this second embodiment is a multicore power cable comprising a number of core elements 21 comprising:

a power or earth conductor 111 coated by a respective insulating sleeve 112, wherein the conductor 111 may comprise a number of stranded conductive wires; or a control or signaling element (e.g. one or more twisted pairs or quads with screen and insulation), or an optical element comprising one or more optical fibers and mechanical protection; or a suspension element (e.g. Kevlar thread), or any combination thereof.

The cable 2 preferably comprises also a sheath 22. The cable 2 further comprises a central element 24 which may be, for instance, a strength member, or a rubber element, or a paper core. The materials of the conductors 211, the sleeves 212 and the sheath 22 are the same as already mentioned above for cable 1 of FIG. 1.

Further, preferably, the cable 2 comprises a hollow tube 23 adapted to be filled at least partially with the traceable material, as already described above. Preferably, according to this embodiment, the hollow tube 23 replaces one of the core elements 21 in cable 2 and has the same size of any core element 21.

Figure 3:
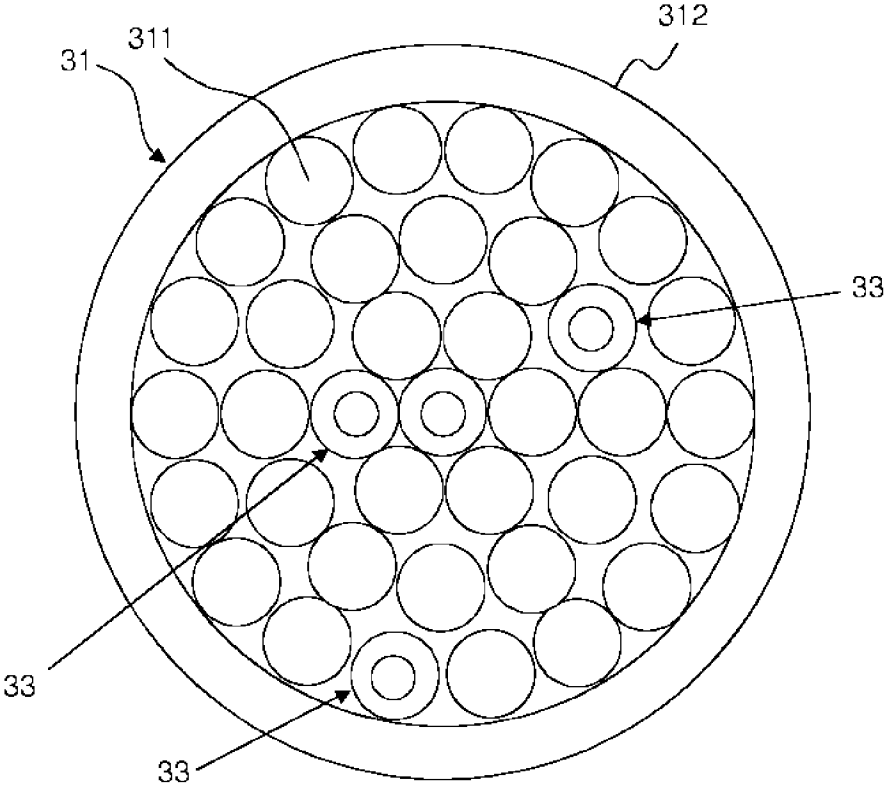
FIG. 3 is a cross section view of a cable according to a third embodiment of the present invention.

FIG. 3 schematically shows the cross section of a core element 31 for a power cable according to a third embodiment of the present invention. The core element 31 comprises a multiwire conductor, preferably having a cross section equal to or greater than 120 $mm^2$, comprising a number of stranded conductive wires 311. The core element 31 further comprises a sleeve 312. The materials of the conductor 311 and the sleeve 312 are the same as already mentioned above for cable 1 of FIG. 1.

Further preferably, the core element 31 comprises a number of hollow tubes 33 adapted to be filled at least partially with the traceable material.

For instance, in a multiwire conductor with class 2 stranded wires DIN VDE 0295 (2005-09) with a cross section of 185 $mm^2$, the number of individual wires may be 37 each having a diameter nearly equal to 2.52 mm. In this case, one or more hollow tubes 33 may replace one or more wires of the conductor. Therefore in this case, the hollow tube 33 has an outer diameter nearly equal to the diameter of a single wire. In order to have the same conductor cross section area, replacing one or more wires in the conductor with the hollow tubes requires that the cross section area of the other wires is enlarged.

According to another example, a conductor with class 5 stranded wires may have a cross section equal to 120 $mm^2$, and each wire may have a diameter of about 0.39 mm. In this case, bunches of 50 to 48 wires may be manufactured in layers, one bunch at the center of the conductor, 6 bunches in a second layer, and 12 bunches in a third layer. The diameter of a single bunch of 50×0.39 mm is approximately 3.16 mm. One or more bunches may be replaced by one or more hollow tubes 33, in any layer. In order to have the same conductor cross section area, replacing one or more bunches in the conductor with the hollow tubes requires that the number of the wires in the other bunches is increased.

Figure 4:
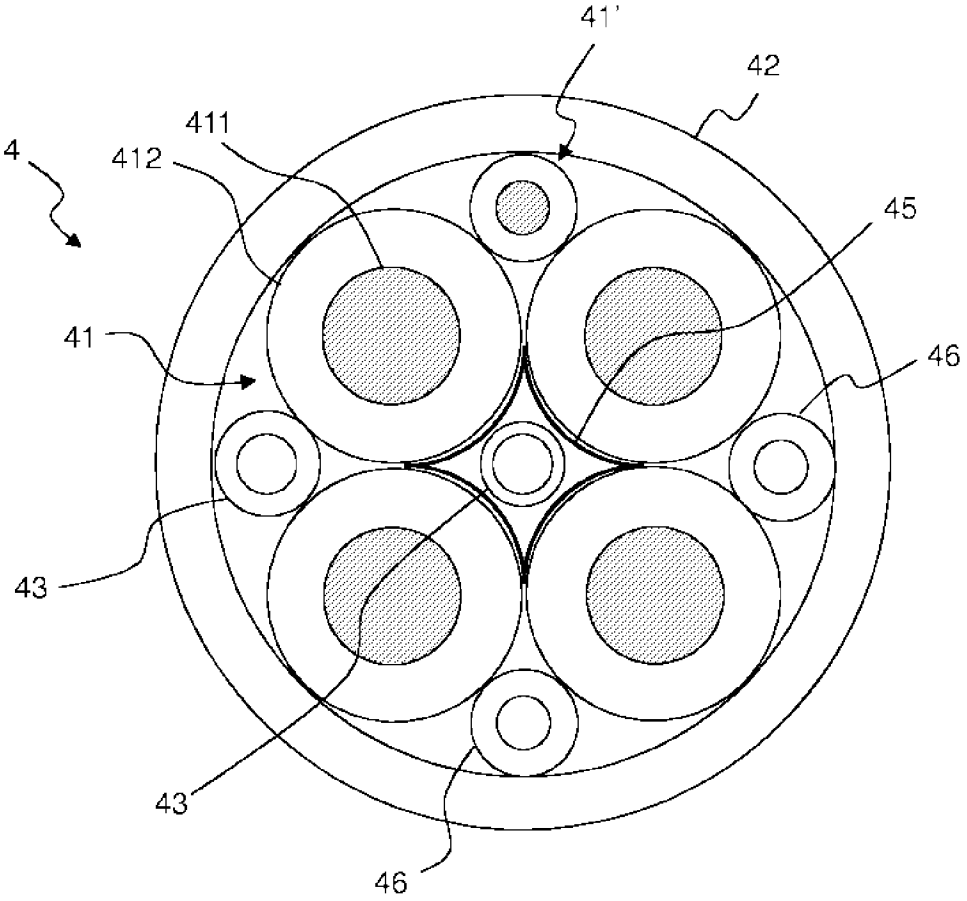
FIG. 4 is a cross section view of a cable according to a fourth embodiment of the present invention.

FIG. 4 schematically shows the cross section of a power cable 4 according to a fourth embodiment of the present invention. Similarly to the cable 1 of FIG. 1, the cable 4 according to this fourth embodiment is a multicore power cable comprising a number of core elements 41, 41' (e.g. four power conductors 41 and one earth conductor 41' in the exemplary cable of FIG. 4), each comprising a conductor 411 coated by a respective sleeve 412, and a sheath 42. The materials of the conductors 411, the sleeves 412 and the sheath 42 are the same as already mentioned above for cable 1 of FIG. 1.

Further, preferably, the cable 4 comprises one or more hollow tubes 43 adapted to be filled at least partially with the traceable material, as already described above. Preferably, according to this embodiment, the hollow tubes 43 are located at interstices among the core elements 41. For instance, as depicted in FIG. 4, a hollow tube 43 may be positioned at the center of the cable, and/or a hollow tube 43 may be positioned in an interstice between the core elements 41 and the sleeve 42. The cable 4 may further comprise a supporting member 45. The cable 4 may comprise other elements 46 that are not relevant to the present description, such as for instance optical fiber elements.

Figure 5:
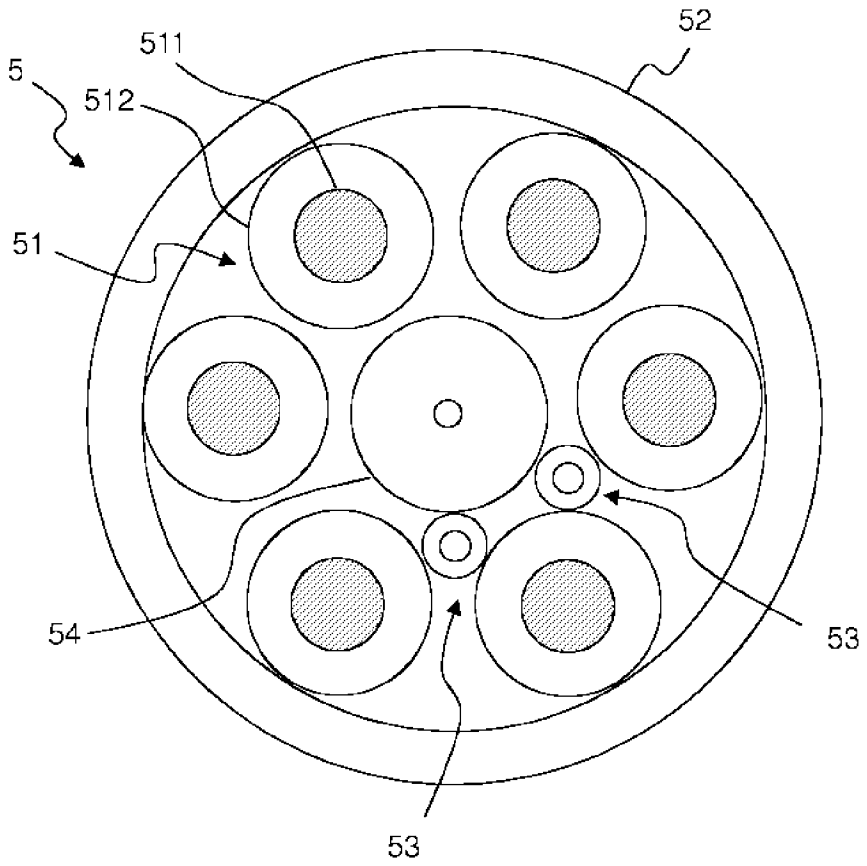
FIG. 5 is a cross section view of a cable according to a fifth embodiment of the present invention.

FIG. 5 schematically shows the cross section of a power cable 5 according to a fifth embodiment of the present invention. The power cable 5 of FIG. 5 is similar to the power cable 2 of FIG. 2. Therefore, a detailed description of the cable elements is not repeated herein after. According to this fifth embodiment, one or more hollow tubes 53 are positioned in the interstices between the central element 54 and the core elements 51. Alternatively, the power cable may comprise both a hollow tube replacing one or more of the core elements as shown in FIG. 2 and hollow tubes placed in the interstices between the central element and the core elements as shown in FIG. 5.

Figure 6:
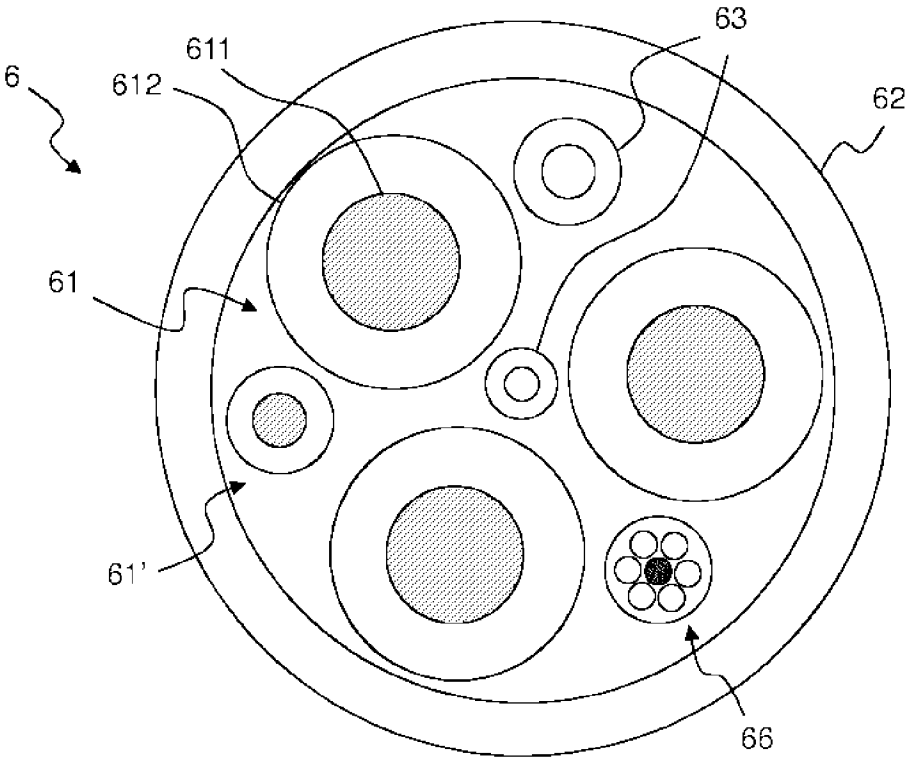
FIG. 6 is a cross section view of a cable according to a sixth embodiment of the present invention.

FIG. 6 schematically shows the cross section of a power cable 6 according to a sixth embodiment of the present invention. Similarly to the cable 1 of FIG. 1, the cable 6 according to this sixth embodiment is a multicore power cable comprising a number of core elements 61, 61' (e.g. three power conductors 61 and one earth conductor 61' in the exemplary cable of FIG. 6), each comprising a conductor 611 coated by a respective sleeve 612, and a sheath 62. Further, preferably, the cable 6 comprises one or more hollow tubes 63 adapted to be filled at least partially with the traceable material, as already described above. Preferably, the hollow tubes 63 are located at interstices among the core elements 61. For instance, as depicted in FIG. 6, a hollow tube 63 may be positioned nearly at the center of the cable, and/or a hollow tube 63 may be positioned in an interstice between two core elements 61 and the sleeve 62. The cable 6 may further comprise an optical fiber element 66.

As already mentioned above, according to the present invention, the liquid with the tracer can be filled in the hollow element of the cable after the cable installation. This avoids the risk of contaminating the cable production site or the risk of cross-contamination of the cables from consecutive production runs on the same manufacturing machine.

Moreover, according to the present invention, when the cable is cut by a thief, the hollow element containing the liquid with the tracer is also cut so that the liquid leaks from the hollow element. In this case, the liquid flows on the conductors and the other elements of the cable and sticks on them as well as on the objects that are come into contact with it, such as, for instance, the clothes or the skin of the thieves. The fluorescent components that may be provided in the liquid composition containing the tracer are immediately and clearly identifiable by official authorities such as the police or other authorized institutions under e.g. UV light, so as to get a straightforward indication of possible theft.

Then, advantageously, the stolen conductors are immediately identifiable by decoding the uniquely identifiable code that provides information such as the owner of the cable, the installation site, the manufacturer identity and so on. The theft can be clearly verified. Moreover, also the objects used for the theft and the individuals involved in the theft may come into contact with the liquid composition and hence be connected to the robbery in a straightforward manner. This provides a very strong deterrence measure to prevent cable thefts.

As said above, according to embodiments of the present invention, the tracer could comprise RFID tag(s). An advantage of the embodiment with RFID tags is that such tags do not have to be scanned manually or oriented in a certain way to be readable.

One tag which can be used in connection with the present invention is "μ-chip". Like other "passive" RFID chips, μ-chip operates simply and requires no batteries or power supply. When it is embedded in an item along with an attached antenna (usually a filament like strip), it will respond to microwaves (e.g. 2.45-gigahertz microwaves) from a scanner by reflecting back a unique ID number (e.g. a 128-bit ID number) stored in its read only memory (ROM). The scanner then checks the number against a database—which can be anywhere in the world—to immediately authenticate the item containing the chip. The chip could be of few millimetres (for instance 3 or 4 mm) on a side and 0.1 mm to 0.25 mm thick.

According to the present invention, the cable 1, 2 may also be marked with an additional exterior marking applied on the sheath 12, 22 indicating that the cable 1, 2 is identifiable. The marking is preferably a string of alphanumeric characters having a meaning immediately understandable by a human individual, such as "DNA secured". Advantageously, this marking is immediately apparent to any individual that handles the cable and therefore provides an additional deterrence measure to prevent stealing of the cable.

Possibly, the exterior marking can be applied or printed in a position indicative of the position of the RFID tag. For instance, having reference to FIG. 1.1, the marking 116 can be substantially opposite with respect to the RFID tag 113.

The present invention also relates to a method for providing a traceable power cable as described above. The method preferably comprises providing a cable comprising one or more core conductors 11, 21, 31, 41, 51, 61 and at least one hollow tube 13, 23, 33, 43, 53, 63 as described above. According to embodiments of the present invention, in a multicore cable, such as cable 1 of FIG. 1 or cable 2 of FIG. 2, the hollow tube 13, 23 is an independent element of the power cable. Preferably, the hollow tube 13, 23 is an independent element among the conductive cores of the cable. According to other embodiments of the present invention, one or more hollow tubes 33 may also be part of a multiwire conductor for a conductive core of an energy transmission cable, as exemplarily depicted in FIG. 3. According to even other embodiments of the present invention, as depicted in FIGS. 4 and 5, one or more hollow tubes 43, 53, 63 may be inserted in the interstices among the conductive cores of the power cable or between the conductive cores and other elements of the cable (e.g. a central element or the sheath of the cable).

The method further preferably comprises filling the hollow tube(s) 13, 23, 33, 43, 53, 63 with the traceable material, as described above. The hollow tube(s) 13, 23, 33, 43, 53, 63 may be filled with the traceable material before or during the installation of the cable, namely before or during laying down the cable at the installation site. Alternatively, the hollow tube(s) 13, 23, 33, 43, 53, 63 may be filled with the traceable material after the installation. Filling the hollow tube(s) 13, 23, 33, 43, 53, 63 with the traceable material may be performed by using a device with positive or negative pressure. Moreover, valves may be inserted at both ends of the hollow tube for filling the hollow tube and closing its ends.

The invention claimed is:

1. A power cable comprising at least one conductor and a hollow tube at least partially filled with a traceable material, wherein said traceable material comprises a tracer associated with a uniquely identifiable code and wherein said traceable material is in a liquid or gel form wherein said hollow tube is an independent element.

2. The power cable according to claim 1, wherein said tracer comprises one or more of: coded synthetic DNA particles, a fingerprint of one or more trace materials, microdots containing a code written thereon.

3. The power cable according to claim 1, wherein said tracer comprises radio-frequency identification, RFID, tags.

4. The power cable according to claim 1, wherein said hollow tube has an inner diameter comprised between about 1 mm and about 10 mm.

5. The power cable according to claim 1, wherein said hollow tube has an outer diameter substantially corresponding to a dimension of an element of said power cable.

6. The power cable according to claim 1, wherein the total conductor cross section is equal to or greater than 120 $mm^2$.

7. The power cable according to claim 1, wherein said hollow tube is an independent element in between said at least one conductor of the cable.

8. The power cable according to claims 1, wherein said outer diameter substantially corresponds to a diameter of a cross section of said at least one conductor.

9. The power cable according to any of claim 1, wherein said at least one conductor is a multiwire conductor and said hollow tube is part of said multiwire conductor.

10. The power cable according to claim 9, wherein the cross section of said at least one conductor is equal to or greater than 120 $mm^2$.

11. The power cable according to claim 9 wherein said outer diameter substantially corresponds to a diameter of a wire or a bunch of wires of said multiwire conductor.

12. The power cable according to claim 1, wherein said hollow tube is obtained by extrusion.

13. The power cable according to claim 1, wherein said hollow tube is made of PVC.

14. A method for providing a traceable power cable comprising providing at least one conductor and a hollow tube within the cable, and filling the hollow tube with a traceable material, wherein said traceable material comprises a tracer associated with a uniquely identifiable code and wherein said traceable material is in a liquid or gel form, wherein said filling the hollow tube with a traceable material having a tracer comprises filling an independent element of the power cable.

15. The method according to claim 14, wherein said filling is performed at an installation site.

16. The method according to claim 14, wherein said filling the hollow tube with a traceable material having a tracer comprises filling the hollow tube with a traceable material comprising one or more of: coded synthetic DNA particles, a fingerprint of one or more trace materials, microdots containing a code written thereon.

17. The method according to claim 14, wherein said filling the hollow tube with a traceable material having a tracer comprises filling the hollow tube with a traceable material comprising radio-frequency identification, RFID, tags.

* * * * *